United States Patent [19]

Tachibana et al.

[11] Patent Number: 4,723,346

[45] Date of Patent: Feb. 9, 1988

[54] APPARATUS FOR THREADING HEDDLES

[75] Inventors: Juro Tachibana; Yoshihide Nishimura, both of Matsuyama, Japan

[73] Assignee: Teijin Seiki Company Limited, Osaka, Japan

[21] Appl. No.: 910,865

[22] Filed: Sep. 24, 1986

Related U.S. Application Data

[62] Division of Ser. No. 719,960, Apr. 4, 1985, abandoned.

[30] Foreign Application Priority Data

Apr. 19, 1984 [JP] Japan ..... 59-79989

[51] Int. Cl.[4] ..... D03J 1/14

[52] U.S. Cl. ..... 28/206

[58] Field of Search ..... 28/203, 204, 205, 206, 28/207; 223/99

[56] References Cited

U.S. PATENT DOCUMENTS

| | | | |
|---|---|---|---|
| 473,849 | 4/1892 | Moyers | 223/99 X |
| 569,853 | 10/1896 | Brodeur | 223/99 X |
| 1,395,818 | 11/1921 | Grupe | 28/205 |
| 2,127,616 | 8/1938 | Peterson | 28/205 |
| 2,179,834 | 11/1939 | Surbeck | 223/99 |
| 3,104,449 | 9/1963 | Fleischer | 28/205 |
| 4,356,604 | 11/1982 | Martin et al. | 28/272 X |
| 4,412,371 | 11/1983 | Hagen et al. | 28/272 X |
| 4,525,906 | 7/1985 | Tovenrath et al. | 28/205 |

FOREIGN PATENT DOCUMENTS

| | | | |
|---|---|---|---|
| 593660 | 10/1947 | United Kingdom | 223/99 |

*Primary Examiner*—Robert R. Mackey

*Attorney, Agent, or Firm*—Cushman, Darby & Cushman

[57] ABSTRACT

An apparatus for passing a thread through a member formed with an opening, comprising; a first member formed with a passageway passing therethrough movable in an axial direction; the first member comprising upper and lower parts which are movable toward and away from each other in a direction substantially perpendicular to the axial direction; a second member formed with a passageway passing therethrough, the second member and the first member being movable toward and away from each in the axial direction; a unit for interposing the member formed with an opening between the first and second members; a unit for transferring the thread to the passageway of the first member; a unit for passing the thread through the passageway of the first member, the opening in the member and the passageway of the second member by vaccum suction; and a unit for taking out the thread passed through the opening of the member from the first member.

2 Claims, 31 Drawing Figures

APPARATUS FOR THREADING HEDDLES

This is a division of our application Ser. No. 719,960, filed Apr. 4, 1985, now abandoned.

FIELD OF THE INVENTION

The present invention relates to a method and an apparatus for passing a thread through a member formed with an opening. More specifically, the present invention relates to a method and an apparatus for automatically passing a warp thread through a heddle eye in a heddle, a drop or the like, by vacuum suction.

SUMMARY OF THE INVENTION

In accordance with one important aspect of the present invention, there is provided a method for passing a thread through a member formed with an opening, comprising the steps of: (1) interposing the member formed with an opening between a first member formed with a passageway passing therethrough and a second member formed with a passageway passing therethrough, the first member comprising upper and lower parts which are movable toward and away from each other; (2) transferring the thread to the passageway of the first member; (3) passing the thread through the passageway of the first member, the opening of the member and the passageway of the second member by vacuum suction; (4) moving the first and second members away from each other in a direction substantially parallel to the path of the thread; (5) separating the upper and lower parts of the first member in a direction substantially perpendicular to the path of the thread; and (6) taking out the thread passed through the opening of the member from the separated first member.

In accordance with another important aspect of the present invention, there is provided an apparatus for passing a thread through a member formed with an opening, comprising: a first member formed with a passageway passing therethrough movable in an axial direction, the first member comprising upper and lower parts which are movable toward and away from each other in a direction substantially perpendicular to the axial direction; a second member formed with a passageway passing therethrough, the second member and the first member being movable toward and away from each other in the axial direction; means for interposing the member formed with an opening between the first and second members; means for transferring the thread to the passageway of the first member; means for passing the thread through the passageway of the first member, the opening in the member and the passageway of the second member by vacuum suction; and means for taking out the thread passed through the opening of the member from the first member.

DESCRIPTION OF THE PRIOR ART

In accordance with known practice, a warp threading apparatus as shown in FIGS. 1(A) and 1(B) has been employed to pass a warp thread WT through a heddle eye 2 in a heddle 1. This apparatus comprises an inlet guide cylindrical member 3 and an outlet guide cylindrical member 4. The inlet guide member 3 is formed with an inlet guide passageway 5 for guiding therethrough a hook member 6 with a hooked end 7 by which a warp thread WT is pulled. Likewise, the outlet guide member 4 is formed with an outlet guide passageway 8 for guiding the hook member 6 therethrough. The hook member 6 has a vertical thin flat portion 6*a* as shown. The inlet guide member 3 is arranged to be movable in the axial direction thereof and comprises upper and lower parts 3*a* and 3*b* (FIG. 2(A)) which are movable toward and away from each other in the direction substantially perpendicular to the axial direction. Likewise, the outlet guide member 4 is arranged to be movable in the axial direction thereof and comprises upper and lower parts 4*a* and 4*b* which are movable toward and away from each other in the direction substantially perpendicular to the axial direction. The warp thread WT is passed through the inlet and outlet guide members 3 and 4 from the left-hand side end of the inlet guide member 3 in FIG. 1(A) to the right-hand side end of the outlet guide member 4 in FIG. 1(A). First and second warp chucks designated by numerals 9 and 10, respectively, are adapted to grip the thread WT and are positioned in the vicinity of the left-hand side end of the inlet guide member 3. The first warp chuck 9 grips loosely the warp thread WT in such a manner that the warp thread WT is readily withdrawn therefrom when pulled by the hook member 6, while the second warp chuck 10 grips closely the warp thread WT in such a manner that the warp thread WT is held in position when pulled by the hook member 6.

In such warp threading apparatus, the inlet and outlet guide members 3 and 4 are first axially spaced apart from each other, as seen from FIGS. 2(A) and 2(B), to allow the heddle 1 to be positioned therebetween. The upper and lower parts of each of the inlet and outlet guide members 3 and 4 are further vertically spaced apart from each other as seen from FIG. 2(A). The heddles 1 are taken out one by one from a heddle magazine (not shown) and caused to move as indicated by the arrow in FIG. 2(B) between the inlet and outlet guide members 3 and 4 by means of a take-up heddle chuck (not shown). In this instance, the heddle 1 is positioned such that the center axis of the heddle eye 2 thereof is in axial alignment with the longitudinal center axis of the inlet guide passageway 5 of the inlet guide member 3 and with the longitudinal center axis of the outlet guide passageway 8 of the outlet guide member 4. The upper and lower parts 3*a* and 3*b* of the inlet guide member 3 are then moved toward each other in the directions indicated by arrows in FIG. 2(A) to connect together to form a single unitary member. At the same time, the upper and lower parts 4*a* and 4*b* of the outlet guide member 4 are moved toward each other in the directions indicated by arrows in FIG. 2(A) to connect together to form a single unitary member. The single inlet and outlet guide members 3 and 4 are further moved axially toward each other to interpose the heddle 1 therebetween as seen from FIGS. 3(A) and 3(B) and further from FIG. 7. On the other hand, the warp thread WT to be passed through the heddle eye 2 is supplied to the first and second warp chucks 9 and 10 by suitable means (not shown). As shown in FIG. 4, the hook member 6 is then inserted into the outlet guide passageway 8 of the outlet guide member 4. The hook member 6 advances through the outlet guide passageway 8 and through the heddle eye 2 and further extends beyond the inlet guide passageway 5 of the inlet guide member 3 to hook the warp thread WT on the hooked end 7 thereof. When the warp thread WT is hooked on the hooked end 7 of the hook member 6, the hook member 6 is caused to move axially in the opposite direction through the inlet guide passageway 5 and through the heddel eye 2 and further through the outlet guide passageway 8. As noted above, since the warp thread WT is gripped loosely by the first warp chuck 9 and closely by the second warp chuck 10, the warp thread WT hooked on the hooked end 7 is withdrawn from the first warp chuck 9 and passed through the inlet guide passageway 5, the heddle eye 2 and the outlet guide passageway 8 by the axial rearward movement of the hook member 6. After passing through the outlet guide passageway 8, the warp thread WT is closely gripped, as shown in FIG. 6(A), by means of a take-up chuck 11 positioned in the vicinity of the outlet side of the outlet guide member 4. The inlet guide member 3 is then axially moved away from the heddle 1 and the upper and lower parts 3*a* and 3*b* thereof are separated in the directions indicated by arrows in FIG. 6(A). At the same time, the outlet guide member 4 is axially moved away from the heddle 1 and the upper and lower parts 4*a* and 4*b* thereof are separated in the directions indicated by arrows in FIG. 6(A). After separations of the inlet and outlet guide members 3 and 4, the warp thread WT passed through the heddle eye 2 is taken out by lateral movements of the second warp chuck 10, the heddle 1 and the take-up chuck 11 in the directions indicated by arrows in FIG. 6(B).

In the presently used warp threading apparatus however, there have been drawbacks which result from the fact that the warp thread is passed through the heddle eye by means of the hook member having a vertical thin flat portion. The first drawback is that the hook member may fail to pass through the heddle eye by the fact that the heddle eye is standardized and that the hook member to be inserted into the standardized eye can not be reduced in cross sectional dimensions since the vertical thin flat of the hook member is limited in mechanical strength. The second drawback is that the hook member can not be rapidly passed through the heddle eye due to the limitation in mechanical strength, resulting in decrease in speed of passing the warp thread through the heddle. It is possible at present that the passing the warp thread through the heddle is twice per second. In this instance, the maximum acceleration of the hook member reached has been between 30 gravities and 40 gravities to reciprocate at a stroke of 600 mm. The third drawback is that the warp thread is subject to being cut since the warp thread is passed through the heddle by the thin hook member. Even if the speed of the hook member were increased, the warp thread would readily be subject to cut due to the increased speed. The fourth drawback is that the process cost of the inlet and outlet guide members is expensive since the inlet and outlet guide passageways in the inlet and outlet guide members are required to be formed highly precisely. The operational mechanism of the guide members is further intricated since the inlet and outlet guide passageways of the inlet and outlet guide members are required to be positioned highly accurately.

It is, accordingly, an important object of the present invention to provide a method and an apparatus for passing a warp thread through the heddle eye by vacuum suction without having recourse to the use of the thin hook member.

It is another important object of the present invention to enhance the speed at which the warp thread is passed through the heddle eye.

It is another important object of the present invention to effectively prevent the warp thread from being cut during the operation.

BRIEF DESCRIPTION OF THE DRAWING

The drawbacks of a prior-art warp threading apparatus and the features and advantages of an apparatus in accordance with the present invention will be more clearly understood from the following description taken in conjunction with the accompanying drawings in which.

DESCRIPTION OF THE PREFERRED EMBODIMENT

Figure 1:
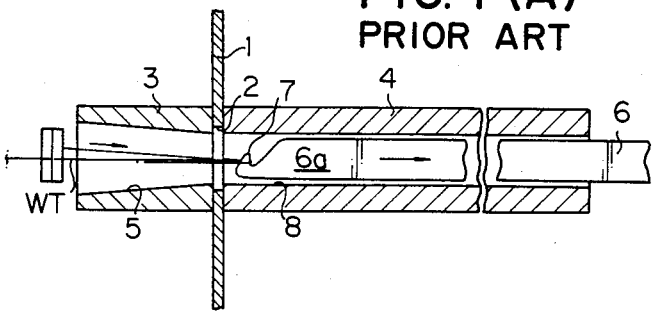
FIG. 1 (A) PRIOR ART
FIG. 1(A) is a fragmentary elevational side view, partly broken away, showing the prior-art warp threading apparatus with a warp thread passed through an inlet guide member, an heddle eye and an outlet guide member by a hook member.
FIG. 1(B) is a fragmentary plan view of the prior-art warp threading apparatus shown in FIG. 1(A)
Figure 1:
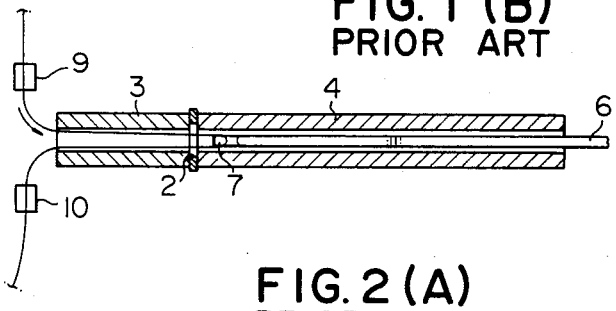
FIG. 1 (B) PRIOR ART
Figure 2:
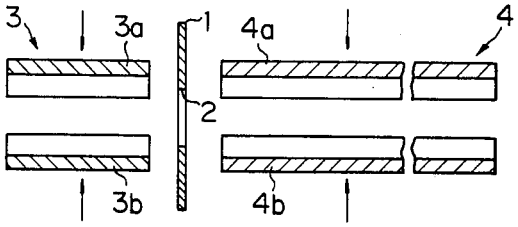
FIG. 2 (A) PRIOR ART
FIG. 2(A) is a fragmentary elevational side view, partly broken away, showing the relative positions of the inlet and outlet guide members at a particular stage in the warp threading cycle of the prior-art warp threading apparatus.
FIG. 2(B) is a fragmentary plan view of the relative positions of the inlet and outlet guide members shown in FIG. 2(A)
Figure 2:
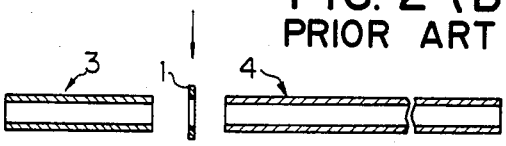
FIG. 2 (B) PRIOR ART
Figure 3:
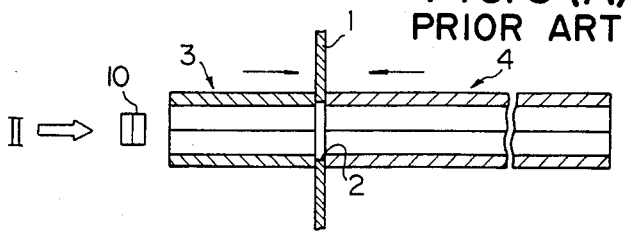
FIG. 3 (A) PRIOR ART
FIG. 3(A) is a fragmentary elevational side view, partly broken away, showing the inlet and outlet guide members moved axially toward each other to interpose the heddle therebetween of the the prior-art warp threading apparatus.
FIG. 3(B) is a fragmentary plan view of the inlet and outlet guide members shown in FIG. 3(A)
Figure 3:
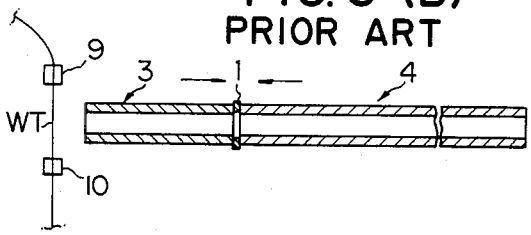
FIG. 3 (B) PRIOR ART
Figure 4:
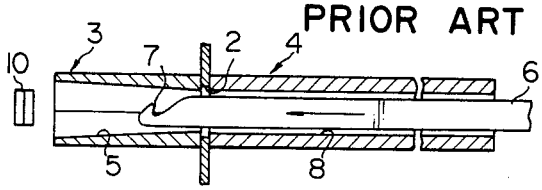
FIG. 4 PRIOR ART
FIG. 4 is a fragmentary elevational side view, partly broken away, showing the hook member inserted into the inlet and outlet guide members shown in FIGS. 3(A) and 3(B)
Figure 5:
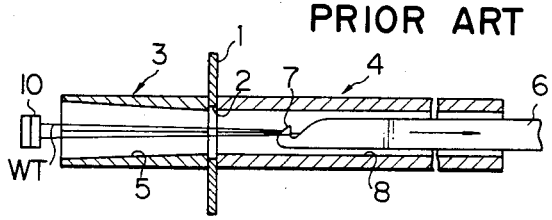
FIG. 5 PRIOR ART
FIG. 5 is a fragmentary elevational side view, partly broken away, showing the warp thread passed through the heddle eye by the hook member shown in FIG. 4.
Figure 6A:
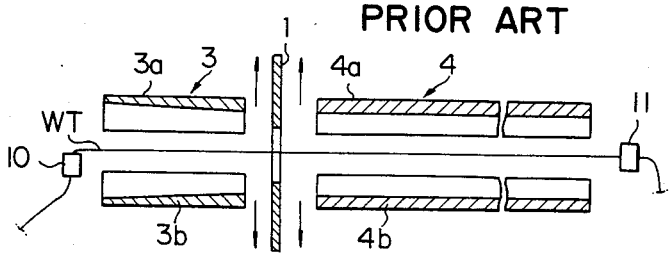
FIG. 6A PRIOR ART
FIG. 6(A) is a fragmentary side view, partly broken away, showing the relative positions of the inlet and outlet guide members at a taking-out stage in the warp threading cycle of the prior-art warp threading apparatus.
Figure 6B:
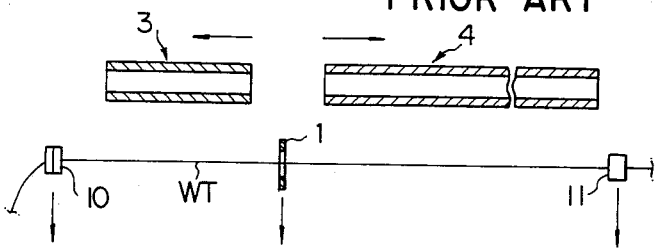
FIG. 6B PRIOR ART
FIG. 6(B) is a fragmentary plan view of the relative positions of the inlet and outlet guide members shown in FIG. 6(A)
Figure 7:
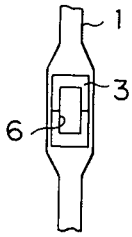
FIG. 7 PRIOR ART
FIG. 7 is an end view showing of the prior-art warp threading apparatus.
Figure 8:
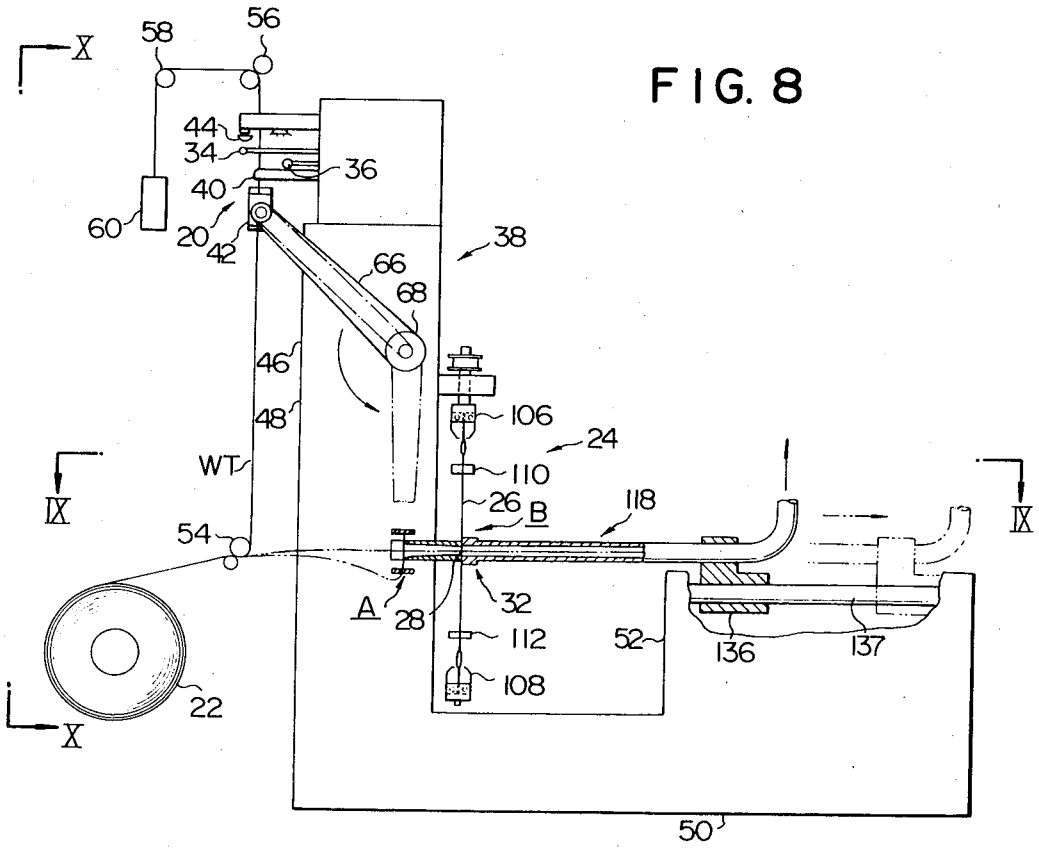
FIG. 8 is a schematic elevational side view, partly broken away, showing the apparatus in accordance with the present invention.

Referring now to the drawings and more specifically to FIG. 8, there is shown a preferred embodiment of an apparatus for passing a warp thread through a heddle eye in a heddle in accordance with the present invention. The apparatus comprises a warp beam 22 having a plurality of warp threads WT wound thereon, warp thread supply means 20 adapted to take out one by one a warp thread WT from the warp beam 22 and tran sfer the warp thread WT to a predetermined position A, a heddle magazine 30 (FIG. 9) having a plurality of heddles 26 each formed with a heddle eye 28, heddle supply means 24 adapted to take out a heddle 26 one by one from the heddle magazine 30 and transfer the heddle 26 to a predetermined position B; warp suction means 32 adapted to pass the warp thread WT in the predetermined position A through the heddle eye 28 in the predetermined position B by vacuum suction; and means for taking out the warp thread WT passed through the heddle eye 28 from the warp suction means 32.

Figure 10:
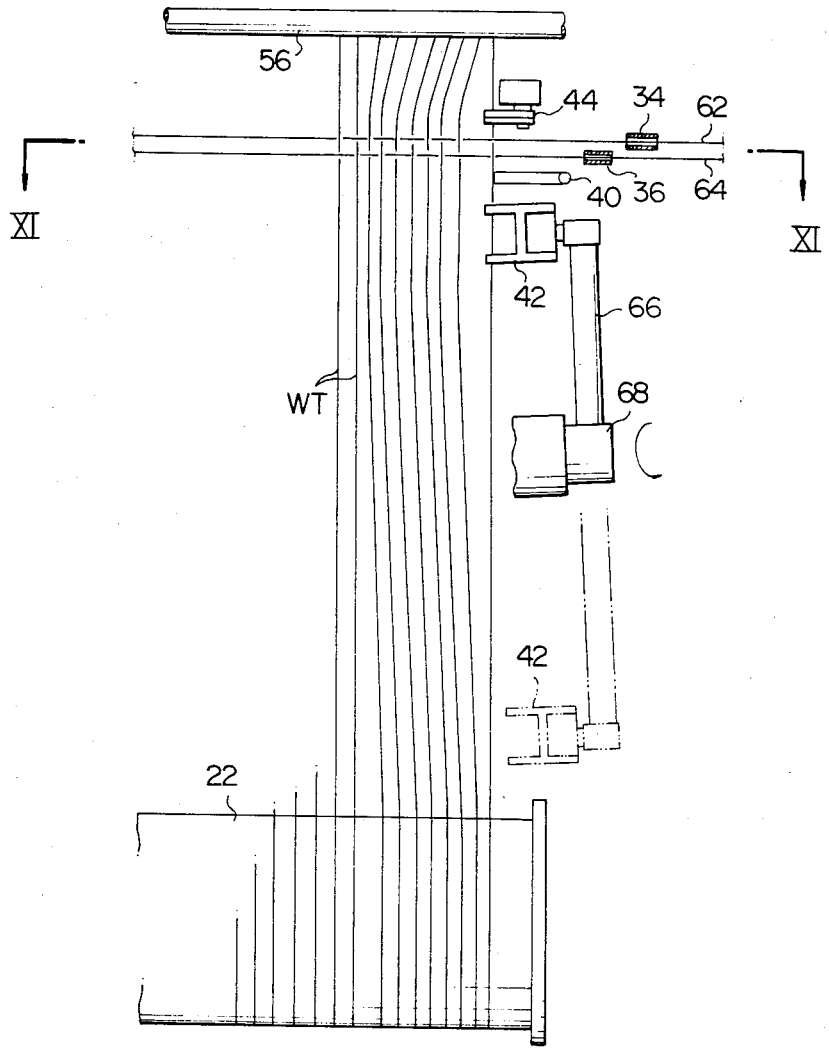
FIG. 10 is a elevational end view, substantially taken along line X—X in FIG. 8, showing warp thread supply means of the apparatus in accordance with the present invention.
Figure 11:
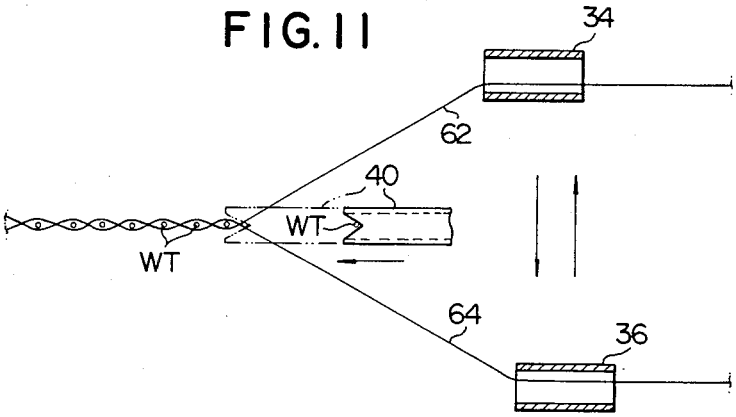
FIG. 11 is an enlarged view, substantially taken along line XI—XI in FIG. 10, of the manner in which the warp thread is released from warp strings by warp guide tubes.
Figure 13:
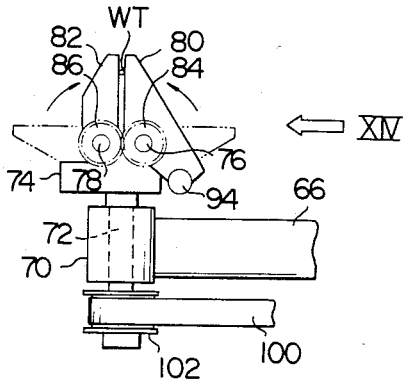
FIG. 13 is a view of warp chuck as viewed from arrow XIII in FIG. 12.
Figure 14:
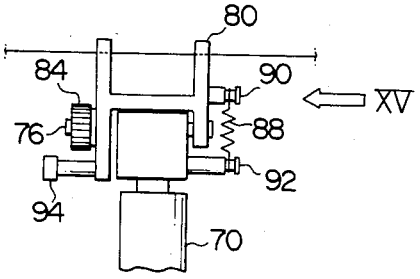
FIG. 14 is a view of the warp chuck as viewed from arrow XIV an FIG. 13.
Figure 15:
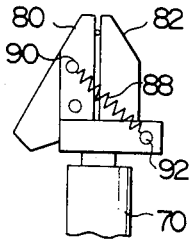
FIG. 15 is a view of the warp chuck as viewed from arrow XV in FIG. 14.

Referring to FIG. 8, there is shown the warp thread supply means 20 which comprises warp guide tubes 34 and 36 arranged in the upper portion of a generally L-shaped frame structure 38, a separation-suction nozzle 40, a warp chuck 42 and a warp cutter 44. The generally L-shaped frame structure 38 is constituted by a front upstanding frame 46 having a front surface 48 extending in parallel to the transverse longitudinal axis of the warp beam 22, a base frame 50 extending from the lower portion of the front upstanding frame 46 and a rear upstanding frame 52 extending upwardly from the rear portion of the base frame 50. Several thousands of warp threads WT wound on the warp beam 22 are first tensioned through tension rollers 54, 56 and 58 by means of a weight member 60. These warp threads WT are arranged transversely in a row along the front surface 48 of the front upstanding frame 46 as shown in FIG. 10. The warp beam 22 is movable transversely with respect to the front surface 48 by suitable drive means (not shown) provided in the L-shaped frame structure 38. As shown in FIG. 11, two pieces of warp strings 62 and 64 extending transversely along the front surface 48 of the front upstanding frame 46 are passed through the warp threads in such a manner that each of the warp threads WT is held by the warp strings 62 and 64. The warp threads WT arranged in a row in the transverse direction are thus prevented from being entangled with one another. The warp strings 62 and 64 are passed through the warp guide tubes 34 and 36, respectively. The warp guide tubes 34 and 36 are movable toward and away from each other so that the warp thread WT is released from the warp strings 62 and 64 which are moved away from each other by the warp guide tubes 34 and 36. The warp thread WT released from the warp strings 62 and 64 is separated from the remainder of the warp threads WT by means of the separation-suction nozzle 40. As shown in FIGS. 8 and 10, the warp chuck 42 forming part of the warp thread supply means 20 is provided at one end of a pivotal arm 66. The pivotal arm 66 is pivotably mounted at the other end thereof on a pivot pin 68 which extends substantially horizontally laterally from the side face of the front upstanding frame 46 of the L-shaped frame structure 38. The pivotal arm 66 is thus pivotable about the pivot pin 68 between an upward position indicated by solid lines in FIG. 8 and a downward position indicated by phantom lines in FIG. 8 with respect to the L-shaped frame structure 38. As shown in FIGS. 13, 14 and 15, on the one end of the pivotal arm 66 is securely supported a bearing 70 in which a chuck shaft 72 is rotatably received. On one end of the chuck shaft 72 is mounted a support block 74 having rotatable pins 76 and 78 rotatably received therein. Generally H-shaped chuck members designated by nemerals 80 and 82 of the warp chuck 42 are securely mounted on the rotatable pins 76 and 78, respectively, and adapted to grip the warp thread WT at two positions as shown in FIGS. 10 and 14. The rotatable pin 76 further has a gear 84 mounted on the axial end thereof. Likewise, the rotatable pin 78 has mounted thereon a gear 86 which is in meshing engagement with the gear 84. Thus, the chuck members 80 and 82 of the warp chuck 42 are rotatable about the rotatable pins 76 and 78 between an open position indicated by phantom lines in FIG. 13 and a closed position indicated by solid lines in FIG. 13 in response to rotation of the gears 84, 86. A tension spring designated by numeral 88 is provided between a fixed pin 90 mounted in the chuck member 80 and a fixed pin 92 mounted in the support block 74 to hold the chuck members 80 and 82 of warp chuck 42 in the open and closed positions. The chuck members 80 and 82 are rotated into the open and closed positions by movement of a projection 94 mounted on the chuck member 80. When gripping the warp thread WT, the chuck members 80 and 82 are rotated into the closed position by engagement of the projection 94 with the flange portion of a member 96

Figure 12:
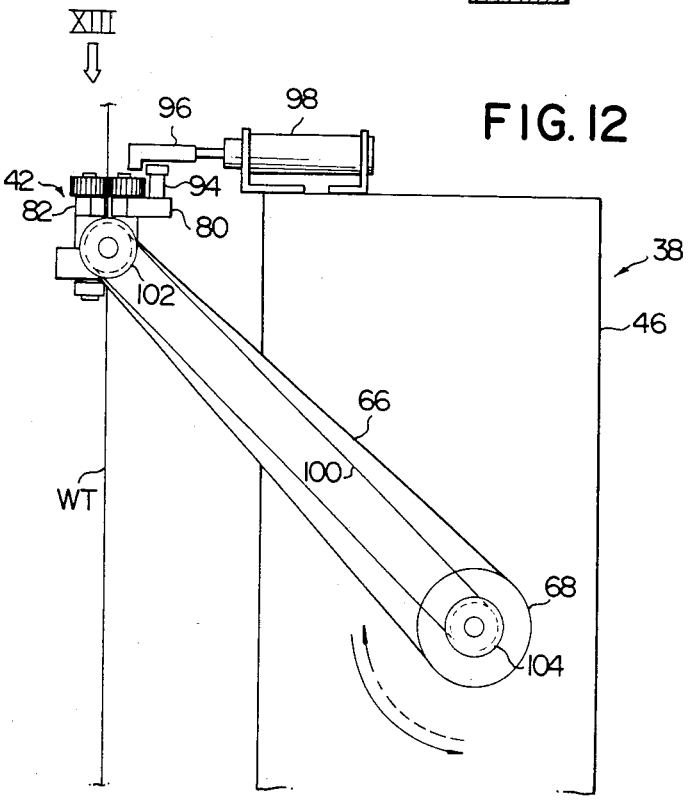
FIG. 12 is an enlarged view of the warp thread supply means shown in FIG. 8.

(FIG. 12) mounted on the piston rod of an air cylinder 98 which in turn is securely mounted through brackets on the upper surface of the front upstanding frame 46 of the L-shaped frame structure 38. On the other hand, when releasing the warp thread WT, the chuck members 80 and 82 are rotated into the open position by engagement of the projection 94 with a stop member (not shown) provided in the vicinity of the predetermined position A. As shown in FIG. 12, a drive belt designated by numeral 100 is in drivingly engagement with a pulley 102 fixedly mounted on the other end of the chuck shaft 72 and with a pulley 104 fixedly mounted on the pivot pin 68. This arrangement permits the chuck members 80 and 82 to be held in position independently of pivotal movement of the pivot arm 66. The above-noted warp cutter 44 forming part of the warp thread supply means 20 is adapted to cut the warp thread WT gripped by the warp chuck 42 at a position above the warp chuck 42 and is driven by a suitable drive means (not shown) provided in the L-shaped frame structure 38. After being cut by the warp cutter 44, the warp thread WT is transferred by the pivotal arm 66 to the predetermined position A.

Figure 9:
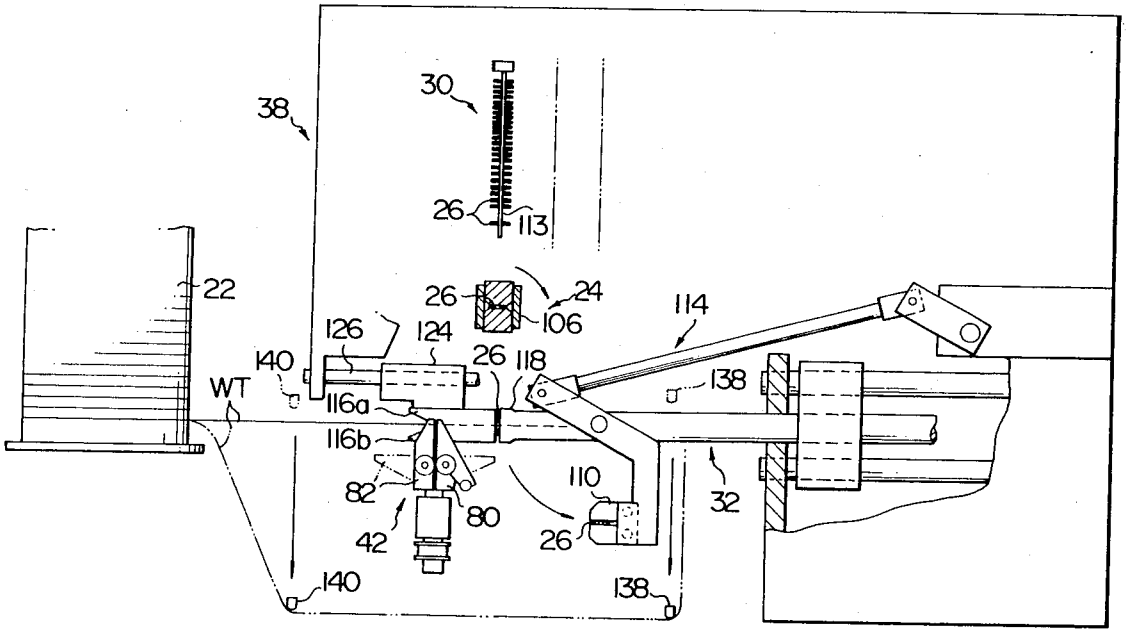
FIG. 9 is a cross sectional view, substantially taken along line IX—IX in FIG. 8, showing heddle supply means of the apparatus in accordance with the present invention.

Referring again to FIGS. 8 and 9, there is shown the heddle supply means 24 adapted to take out the heddles 26 one by one from the heddle magazine 30 and transfer the heddle 26 to the predetermined position B. The heddle supply means 24 comprises a pair of take-up heddle chucks 106 and 108 vertically spaced apart to take up the heddles 26 one by one from the heddle magazine 30 and transfer the heddle 26 to the predetermined position B, and a pair of transfer heddle chucks 110 and 112 vertically spaced apart within the take-up heddle chucks 106 and 108 to grip the opposite upward and downward ends of the heddle 26 transferred in the predetermined position B during passing of the warp thread WT through the heddle eye 28 and transfer the heddle 26 having the warp thread WT passed through the heddle eye 28 therein to distributing heddle chucks (not shown) in the following process after completion of the threading. The transfer heddle chucks 110 and 112 are driven to rotate in the direction indicated in FIG. 9 through a link mechanism 114 by means of suitable drive means (not shown) provided in the L-shaped frame structure 38. The heddle magazine 30 is provided with a pair of upper and lower magazine horizontal elongate rods 113 into which a plurality of the heddles 26 with upper and lower counter bores **26*a* and 26*b* (FIG. 16(A)) are inserted. After the take-up heddle chucks 106 and 108 take up the heddle 26 from the heddle magazine 30, the take-up heddle chucks 106 and 108 are caused to turn in the direction indicated by the arrow in FIG. 9 so that the warp thread maybe passed through the heddle eye 28. The take-up heddle chucks 106 and 108 turned in the direction indicated by arrow in FIG. 9 are then moved together with the heddle 26 into the predetermined position B. In this instance, the turning direction of the heddle 26 may be different depending upon the kinds of the heddles 26. The take-up heddle chucks 106 and 108 are driven by means of suitable drive means (not shown) provided on the L-shaped frame structure 38**.

Figure 16A:
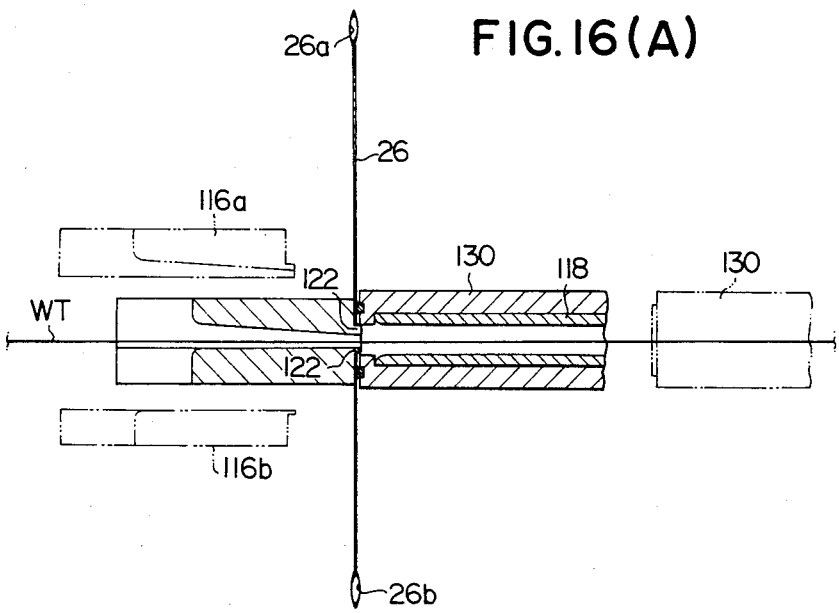
FIG. 16(A) is an enlarged fragmentary side view, partly broken away, showing warp guide and suction nozzles of the warp suction means with a heddle interposed therebetween.
Figure 16:
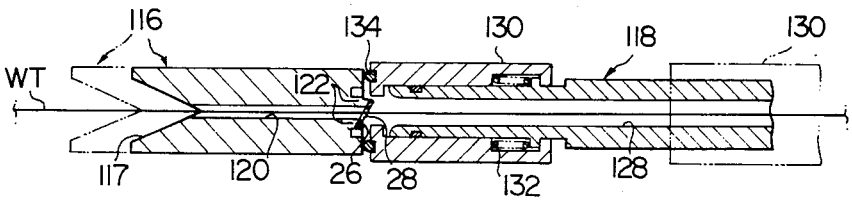
FIG. 16(B) is an enlarged fragmentary plan view of the warp guide and suction nozzles shown in FIG. 16(A)

Referring to FIGS. 16(A) and 16(B), there are shown a wrap guide nozzle generally indicated by numeral 116 and a warp suction nozzle generally indicated by numeral 118 which form part of the warp suction means 32. The warp guide nozzle 116 is adapted to guide to the heddle 26 the warp thread WT supplied by the warp chuck 42 of the warp thread supply means 20. The warp suction nozzle 118 is adapted to pass the warp thread WT through the heddle eye 28 by vacuum suction. The heddle 26 is interposed at the predetermined position B between the warp guide nozzle 116 and warp suction nozzle 118 as shown. The warp guide nozzle 116 is constituted by a cylindrical member and formed with a guide passageway 120 and includes upper and lower parts **116*a* and 116*b* which are movable toward and away from each other as shown in FIG. 16(A). The warp guide nozzle 116 is further formed at one end thereof with a V-shaped recess 117 to effectively guide the warp thread WT to the heddle 26. The guide passageway 120 is also tapered toward the one end of the warp guide nozzle 116 to effectively guide the warp thread WT to the heddle 26. The warp guide nozzle 116 is further formed at the other end with projections 122 into which the heddle eye 28 of the heddle 26 is to be inserted and by which the heddle 26 is held in the predetermined position B. In this instance, the heddle 26 is held so as to be inclined with respect to the guide passageway 120 of the warp guide nozzle 116 since the part including the heddle eye 28 is inclined at a predetermined angle with respect to the remainder part of the heddle 26. As shown in FIG. 9, the warp guide nozzle 116 is horizontally arranged parallel to the path of the warp threads WT in such a manner that the upper and lower parts 116*a* and 116*b* thereof is movable toward and away from each other with respect to the path of the warp thread WT by a slide block 124 slidably mounted a horizontal guide rod 126 which is secured to the L-shaped frame structure 38. The slide block 124 is equipped with a cam mechanism (not shown) which is actuated by reciprocal movement thereof on the guide rod 126. The cam mechanism is adapted to drive the upper and lower parts 116*a* and 116*b* of the warp guide nozzle 116 to move toward and away from each other with resepct to the path of the warp thread WT. The slide block 124 is driven to move on and along the horizontal guide rod 126 by means of suitable drive means (not shown). On the other hand, the warp suction nozzle 118 forming part of the warp suction means 32 is constituted by a cylindrical member and formed with a suction passageway 128 which is in axial alignment with the guide passageway 120 of the warp guide member 116. The warp suction nozzle 118 is provided at the leading end thereof with a buffer cylindrical sleeve 130 with a helical compression spring 132 to absorb impact force when brought into abutting engagement with the warp guide nozzle 116. The buffer cylindrical sleeve 130 has an O-ring 134 attached in a circumferential recess formed in the axial end face thereof to provide hermetical sealing when the warp suction nozzle 118 is brought into abutting engagement with the warp guide nozzle 116. As shown in FIG. 8, the warp suction nozzle 118 is mounted in axial bore formed in a guide block 136 which is slidably mounted on an axial elongate guide shaft 137 secured to the rear upstanding frame 52 of the L-shaped frame structure 38. The warp suction nozzle 118 is driven to axially move toward and away from the warp guide nozzle 116 by means of suitable drive means (not shown). To the warp suction nozzle 118 is communicated suitable vacuum creating means (not shown), for example, such as a vacuum pump, a suction gun or the like through a flexible pipe (not shown). In FIG. 9, a transfer chuck and guide bar designated by numerals 138 and 140, respectively, are provided to take out the heddle 26 with the warp thread WT passed through the heddle eye 28 from the warp guide nozzle 116. After the warp thread WT is passed through the heddle eye 28, the transfer chuck 138 grips the leading end portion of the warp thread WT and the guide bar 140 is brought into contact with the trailing end portion of the warp thread WT. The transfer chuck 138 and guide bar 140 are then caused to move transversely in the directions indicated by arrows in FIG. 9 to take out the heddle 26 from the warp suction means 32. The above-noted warp thread supply means 20, heddle supply means 24, warp beam 22 and warp suction means 32** are synchronous with one another and mechanically connected with one another through cams, gears, link members, limit switches and so on to be actuated in corporation with one another.

The method for passing the warp thread through the heddle eye and the operation of the apparatus therefor will now be described in detail in conjunction with FIGS. 17(A) and 17(B) to 21(A) and 21(B).

Figure 17B:
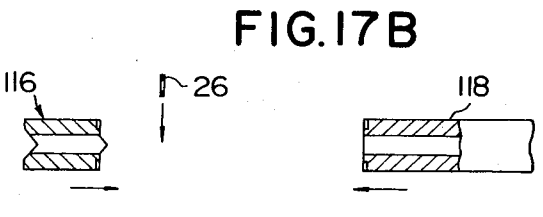
FIG. 17(B) is a fragmentary plan view of the relative positions of the warp guide and suction nozzles shown in FIG. 17(A)
Figure 17A:
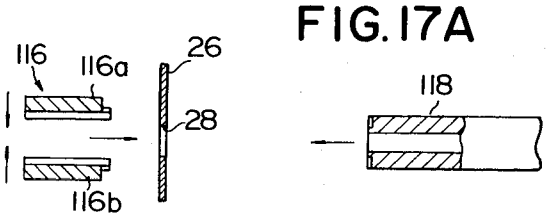
FIG. 17(A) is a fragmentary elevational side view, partly broken away, showing the relative positions of the warp guide and suction nozzles at an initial stage in the warp threading cycle of the present invention.
Figure 18B:
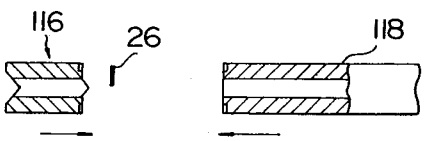
FIG. 18(B) is a fragmentary plan view of the further stage shown in FIG. 18(A)
Figure 18A:
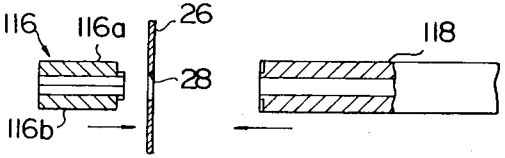
FIG. 18(A) is a fragmentary elevational side view, partly broken away, showing a further stage from the initial stage shown in FIG. 17(A)
Figure 19B:
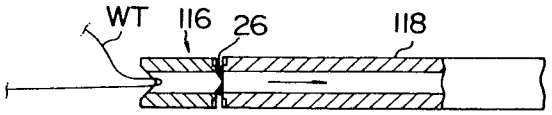
FIG. 19(B) is a fragmentary plan view of the relative positions of the warp guide and suction nozzles shown in FIG. 19(A)
Figure 19A:
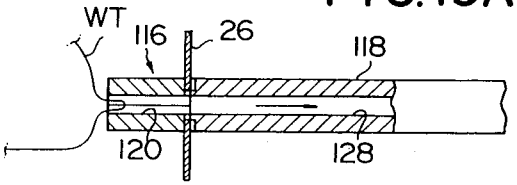
FIG. 19(A) is a fragmentary elevational side view, partly broken away, showing the relative positions of the warp guide and suction nozzles at a suction stage in the warp threading cycle of the present invention.
Figure 20B:
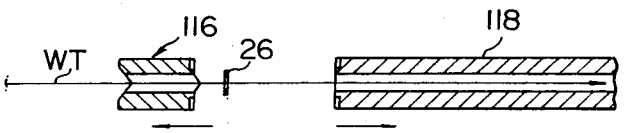
FIG. 20(B) is a fragmentary plan view of the further stage shown in FIG. 20(A)
Figure 20A:
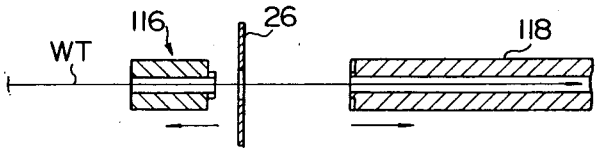
FIG. 20(A) is a fragmentary elevational side view, partly broken away, showing a further stage from the suction stage shown in FIG. 19(A)
Figure 21B:
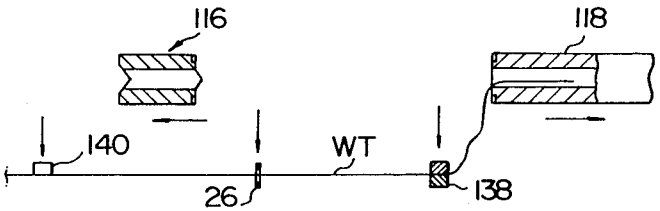
FIG. 21(B) is a fragmentary plan view of the taking-out stage shown in FIG. 21(A)
Figure 21A:
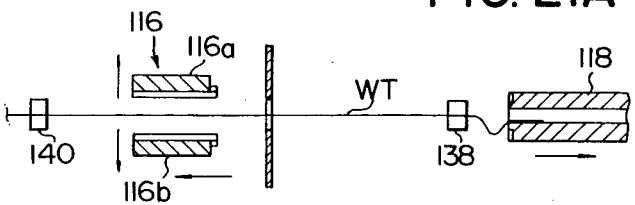
FIG. 21(A) is a fragmentary elevational side view, partly broken away, showing the relative positions at a taking-out stage.

The heddle 26 is first gripped at the upper and lower ends thereof and taken out from the heddle magazine 30 by the take-up heddle chucks 106 and 108 of the heddle supply means 24. The take-up heddle chucks 106 and 108 with the heddle 26 gripped thereby are caused to turn in the predetermined direction so that the warp thread WT may be passed through the heddle eye 28. The take-up heddle chucks 106 and 108 are then transferred in the predetermined position B between the warp guide nozzle 116 with the upper and the lower parts 116*a* and 116*b* moved away from each other and the warp suction nozzle 118 as shown in FIGS. 17(A) and 17(B). The upper and lower parts 116*a* and 116*b* of the warp guide nozzle 116 are moved toward each other to connect together to form a single unitary member as seen from FIGS. 17(A) and 18(A). The warp guide nozzle 116 and the warp suction nozzle 118 are then axially moved toward each other to interpose the heddle 26 therebetween. At this time, the projections 122 of the warp guide nozzle 116 project into the heddle eye 28 of the heddle 26, so that the heddle 26 is held in position. The heddle 26 is then securely supported by the transfer heddle chucks 110 and 112 vertically spaced apart within the take-up heddle chucks 106 and 108. On the other hand, in the warp thread supply means 20, the warp guide tubes 34 and 36 are moved away from each other so that the warp thread WT is released from the warp strings 62 and 64 which are moved away from each other. The warp thread WT released from the warp strings 62 and 64 is separated from the remainder of the warp threads WT by means of the separation-suction nozzle 40. The chuck members 80 and 82 of the warp chuck 42 are then rotated into the closed position by engagement of the projection 94 on the warp chuck 42 with the flange portion of the member 96 mounted on the piston rod of the air cylinder 98. As a consequence, the warp thread WT separated is gripped by the warp chuck 42 and then cut at the position above the warp chuck 42 by the warp cutter 44. The warp thread WT gripped by the chuck members 80 and 82 of the warp chuck 42 is transferred to the warp guide nozzle 116 by pivotal movement of the pivotable arm 66. The warp thread WT transferred to the warp guide nozzle 116 is released from the chuck members 80 and 82 by engagement of the projection 94 with the stop member provided in the vicinity of the warp guide nozzle 116. At the same time, the warp thread WT is passed through the guide passageway 120 of the warp guide nozzle 116, and through the heddle eye 28, and further through the suction passageway 128 of the warp suction nozzle 118 by vaccum suction as seen from FIGS. 19(A) and 19(B). Thus, the warp thread WT is passed through the heddle eye 28. In this instance, when the chuck members 80 and 82 of the warp chuck 42 are rotated into the open position, the warp chuck 42 is caused to return to the initial position thereof by the pivotal movement of the pivotable arm 66. After the warp thread WT is passed through the heddle eye 28 and with the warp thread WT pulled by vaccum suction, the warp guide nozzle 116 and the warp suction nozzle 118 are axially moved away from each other by the drive means therefor as seen from FIGS. 20(A) and 20(B). The upper and lower parts 116*a* and 116*b* of the warp guide nozzle 116 are then moved away from each other as seen from FIG. 21(A). With this condition, the transfer chuck 138 grips the leading end portion of the warp thread WT and the guide bar 140 is brought into contact with the trailing end portion of the warp thread WT. The transfer chuck 138, the guide bar 140 and the heddle 26 are then caused to move transversely in the directions indicated by arrows in FIG. 21(B) to take out the warp thread WT from the warp guide nozzle 116 of the warp suction means 32. After completion of the threading, the heddle 26 is transferred from the transfer heddle chucks 110 and 112 to the distributing heddle chucks (not shown) in the following process. The next warp thread WT is then passed automatically through the heddle eye 28 by repetition of the cycle described hereinbefore.

In the embodiment of the present invention described hereinbefore, the speed at which the warp thread is passed through the heddle eye is remarkably enhanced since the threading is done by vacuum suction without having recourse to the presently used hook member. In accordance with our experimental results, flow speed of 83 m/sec is obtained under vacuum of 500 mmHg or 0.667 bar. In this instance, if the ratio of the speed of the warp thread to the flow speed is 0.5, the speed of the warp thread of 41.5 m/sec is obtained. Accordingly, the time of passing through a guide passageway of 600 mm is 0.014 sec. Thus, the speed of the threading is remarkably enhanced as compared with the speed of 0.12 sec obtained by the use of the hook member. It will be readily apparent to those skilled in the art that the present invention has general utility as a means for passing a warp thread through a heddle eye in a heddle. Thus, various modifications and re-arrangements may be made in the embodiment selected for disclosing our invention without departing from the spirit and scope of the invention.

What is claimed is:

1. An apparatus for passing a warp thread through a heddle eye in a heddle, comprising:

a warp beam having a plurality of warp threads wound thereon;

warp thread supply means adapted to take out a warp thread one by one from said warp beam and transfer the warp thread to a predetermined first position;

a heddle magazine having a plurality of heddles formed with a heddle eye;

heddle supply means adapted to take out a heddle one by one from said heddle magazine and transfer the heddle to a predetermined second position;

warp suction means adapted to pass the warp thread in the predetermined first position through the heddle eye in the heddle in the predetermined second position by vacuum suction;

said warp suction means comprising a warp guide nozzle formed with a guide passageway and a warp suction nozzle formed with a suction passageway which is in an axial alignment with said guide passageway of the warp guide nozzle, the warp guide nozzle and the warp suction nozzle being movable toward and away from each other in an axial direction thereof, the warp guide nozzle including upper and lower parts which are movable toward and away from each other in a direction substantially perpendicular to said axial direction, the warp suction nozzle being provided with a buffer cylindrical sleeve with a spring to absorb impart force when brought into abutting engagement with the warp guide nozzle; and means for taking out the warp thread passed through the heddle eye in the heddle from said warp suction means.

2. A apparatus as set forth in claim 1, in which said buffer cylindrical sleeve of said warp suction nozzle has an O-ring attached thereto to provide hermetical sealing when said warp suction nozzle is brought into abutting engagement with siad warp guide nozzle.

* * * * *